United States Patent [19]

Cummins

[11] Patent Number: 4,984,682

[45] Date of Patent: Jan. 15, 1991

[54] EYEGLASS HOLDER

[76] Inventor: Susan Cummins, 12 Canal Run West, Washington Crossing, Pa. 18977

[21] Appl. No.: 466,767

[22] Filed: Jan. 18, 1990

[51] Int. Cl.[5] ..... H45G 11/04

[52] U.S. Cl. ..... 206/5

[58] Field of Search ..... 206/5, 6

[56] References Cited

U.S. PATENT DOCUMENTS

| | | | |
|---|---|---|---|
| 2,385,842 | 10/1945 | Pratt | 206/5 R |
| 2,546,755 | 3/1951 | Jones | 206/5 R |
| 2,723,745 | 11/1955 | McNeill | 206/5 R |
| 2,805,766 | 9/1957 | Nathan | 206/5 R |
| 3,000,417 | 9/1961 | Goldstein | 206/5 R |
| 4,290,522 | 9/1981 | Takasaki | 206/5 R |
| 4,823,943 | 4/1989 | Chang | 206/5 R |

FOREIGN PATENT DOCUMENTS

| | | | |
|---|---|---|---|
| 476141 | 8/1951 | Canada | 206/5 |
| 692288 | 7/1930 | France | 206/5 |
| 1063494 | 12/1953 | France | 206/5 |
| 1129298 | 9/1956 | France | 206/5 |
| 2605504 | 4/1988 | France | 206/5 |
| 445064 | 4/1936 | United Kingdom | 206/5 |

*Primary Examiner*—William I. Price

*Attorney, Agent, or Firm*—Joseph W. Molasky & Assocs.

[57] ABSTRACT

A thin and light weight eyeglass case that utilizes a protective member between an inner lining and an outer skin to prevent possible damage to the eyeglasses. A flap to which a strap is joined is also provided for securing the frame and temple ear pieces to the case. The eyeglass case provides maximum optical protection while assuming minimal space with an accompanying sleeked-down shape.

16 Claims, 5 Drawing Sheets

FIG. 1
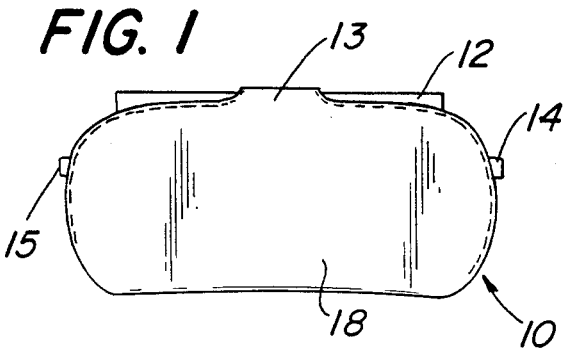
FIG. 5
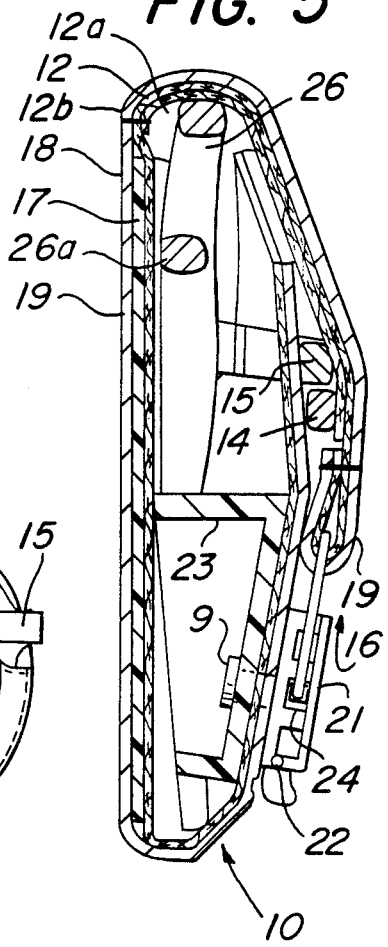
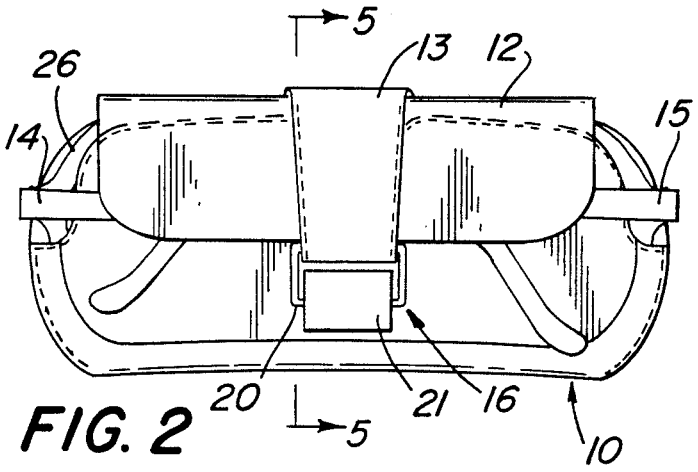
FIG. 2
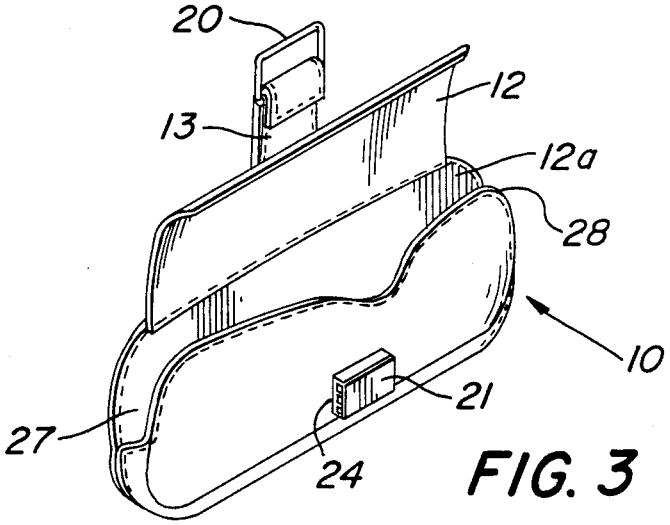
FIG. 3

FIG. 8
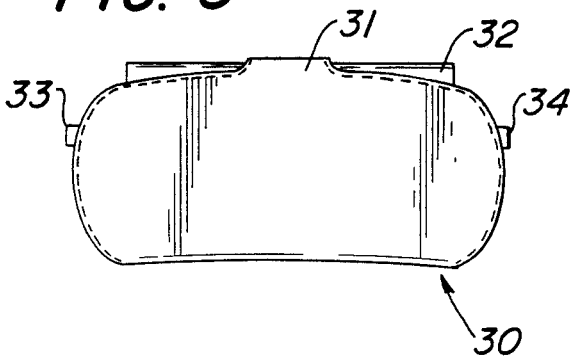
FIG. 11
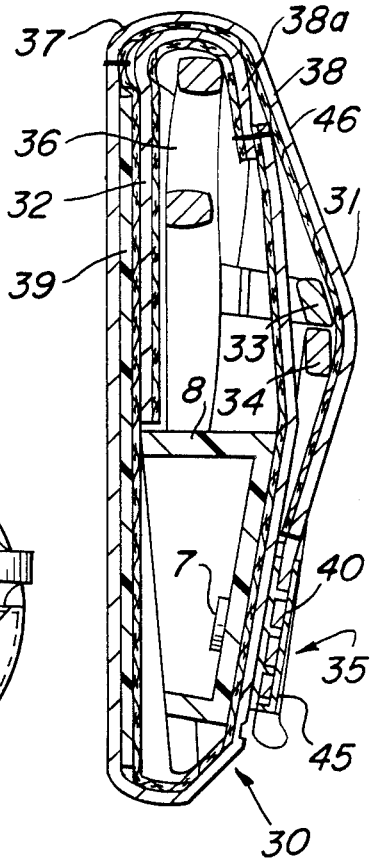
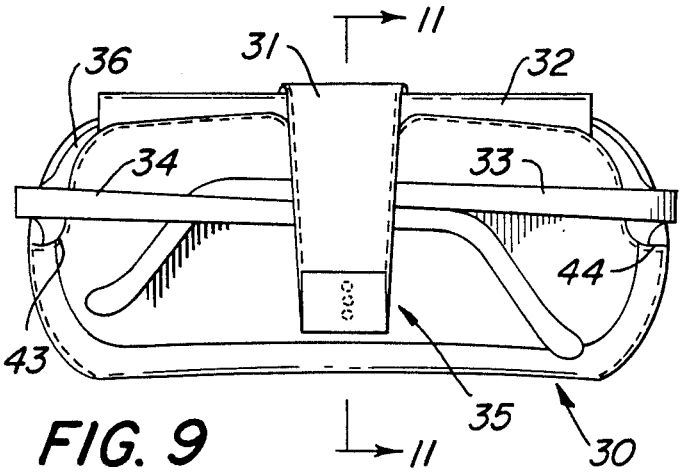
FIG. 9
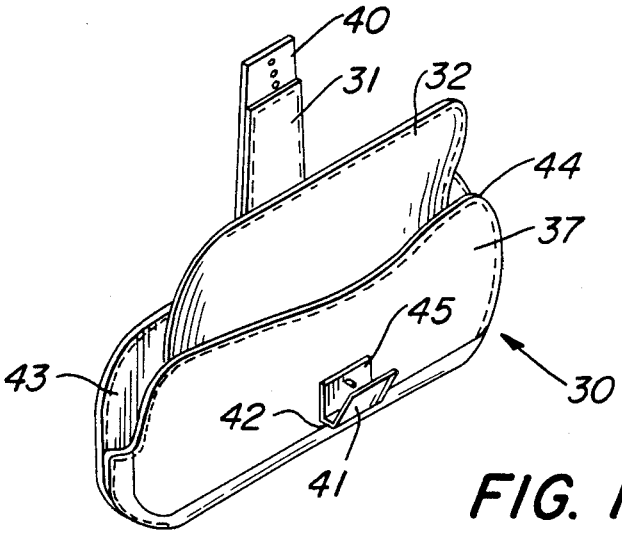
FIG. 10

FIG. 12
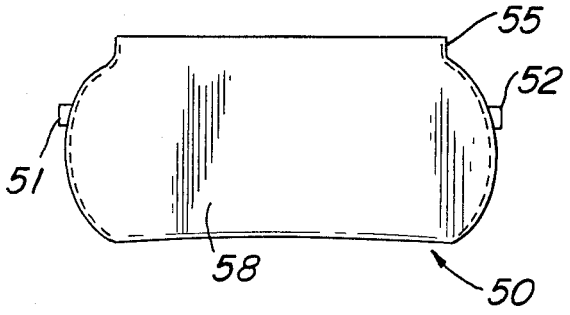
FIG. 15
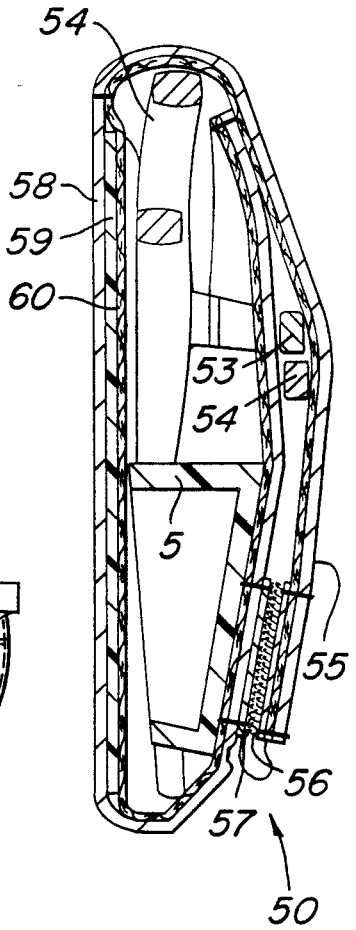
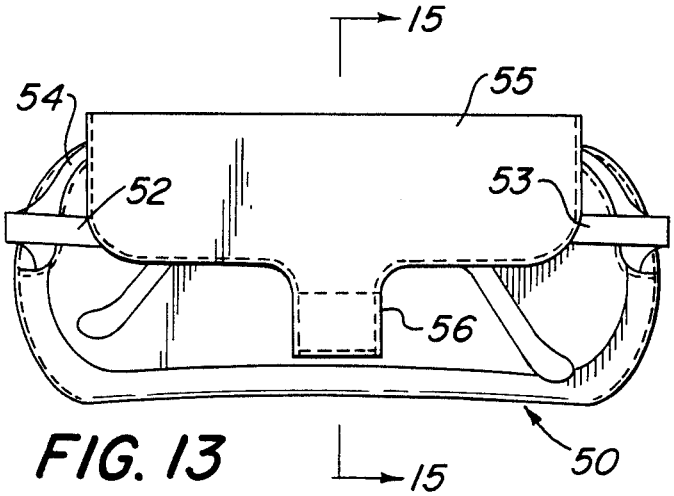
FIG. 13
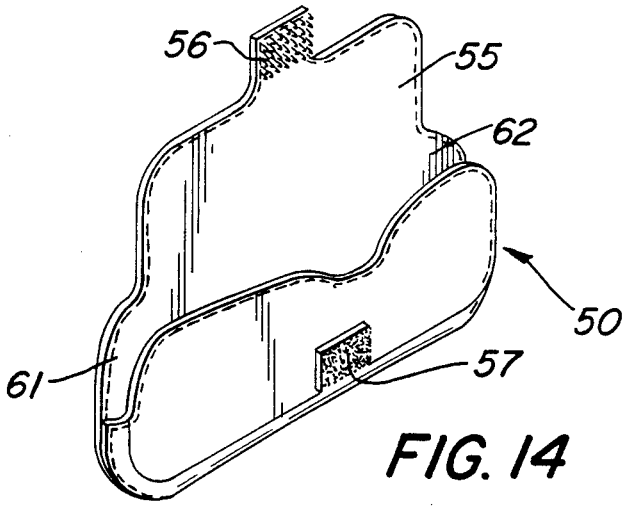
FIG. 14

FIG. 16
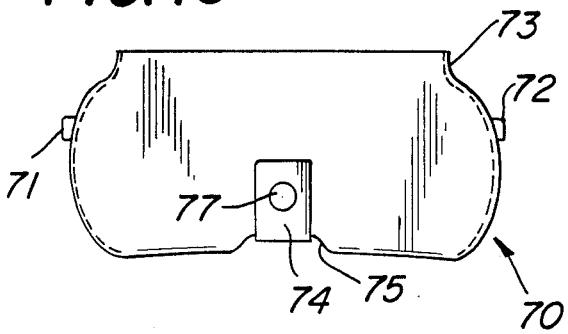
FIG. 19
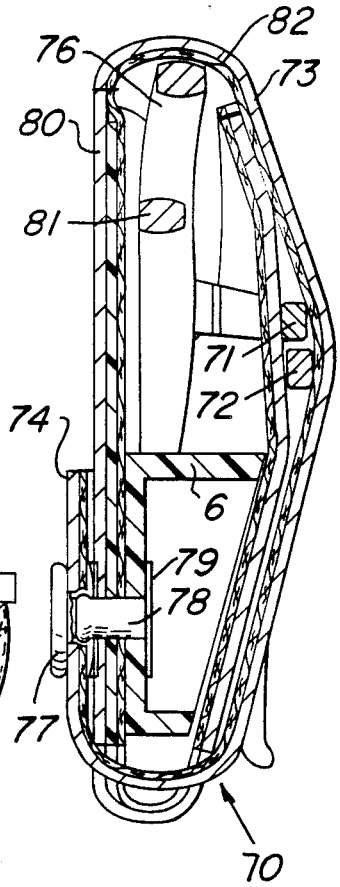
FIG. 17
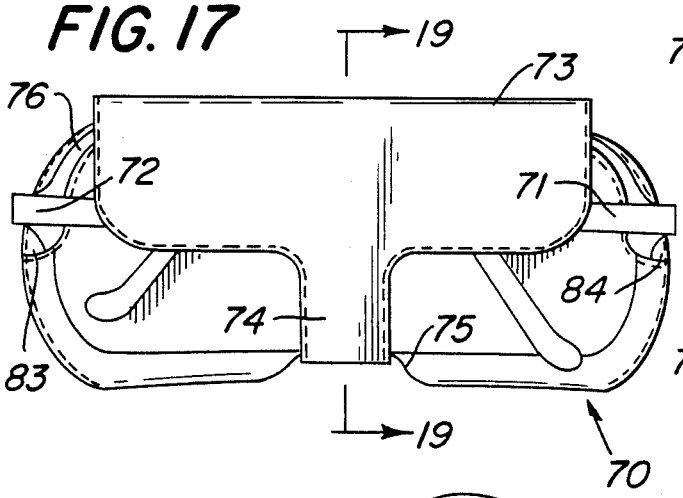
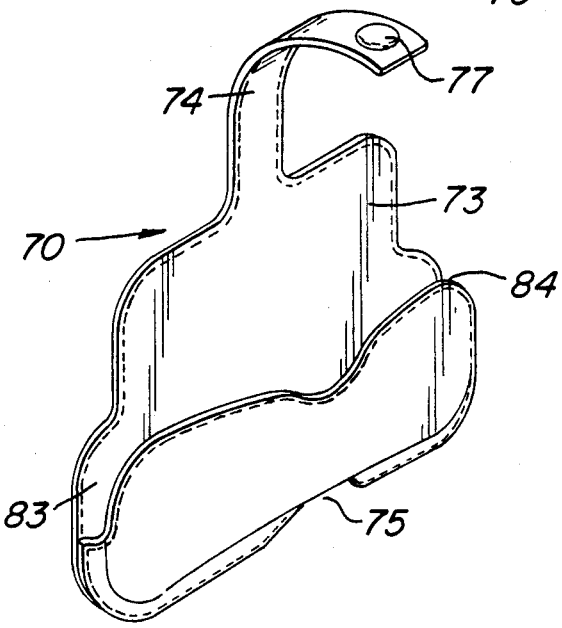
FIG. 18

EYEGLASS HOLDER

BACKGROUND OF THE INVENTION

The present invention relates to an eyeglass case and, in particular, to a case which provides maximum protection in a compact storage member.

It is well recognized that present-day eyeglass cases do not satisfy a need for a receptacle that is slim and sleek in design but which nevertheless carries a variety of different frames safely and securely. Eyeglass cases that afford maximum protection are a necessity in today's marketplace in view of the high cost associated with prescription lenses including the frames. This is particularly true with respect to prescription glasses that are polychromic in nature.

The present invention has effectively solved the limitations of the prior art by providing a contoured shape eyeglass case that is compact in outline but includes a hard shell on the front side of the case for supporting and protecting the lenses.

This invention also includes an adjustable strap which enables the temples of the frame to be folded and securely held in place outside the rear flexible panel of the case.

SUMMARY OF THE INVENTION

This invention relates to a contoured eyeglass case that provides a thin and lightweight core made of plastic or similar material that is interposed between the outer skin and inner lining along the front portion to protect the lenses and frames.

Similarly a triangular insert is provided between the front and back lining of the case for resting the nose guards of the eyeglass frames when located within the case. The insert reduces movement of the eyeglasses within the case and therefore protects it against damage from excessive rattling motion.

The front of the case extends into a flap and strap unit that is folded to the rear during closure in one version of the invention. The strap is provided with a clasp that is adapted to mate with another clasp that is also located on the rear of the case. The clasp mechanism is adjustable in order to accommodate different frame sizes.

The strap device may be varied in operation depending upon the case model provided and may take the form of a belt action, a connection using Velcro material or an adjustable tooth action.

The eyeglass frame is placed into the case from the top wherein the nose guard is made to rest on the triangular insert, and the temple ear pieces are folded outside the back panel of the case to prevent them from rubbing against the lenses. These ear pieces are then secured when the flap with strap extension from the front side is folded over, or alternatively under them, and attached to the lower back side by the adjustable clasp.

The flap may also be folded over the back of the case and the temple ear pieces. The adjustable strap may be folded around the back and underneath the case for attachment to the bottom portion of the front side with an adjustable clasp.

BRIEF DESCRIPTION OF THE DRAWINGS

FIG. 1 is a front view of the glass case embodiment of FIG. 2.

FIG. 2 is a rear view of a glass case embodiment of the invention utilizing a clamp type clasp where the temple pieces are oriented outside the case and covered by a flap.

FIG. 3 is another view of the embodiment of FIG. 2 with the flap and strap in an open position.

FIG. 5 is a sectional view taken along line 5—5 of FIG. 2.

FIG. 8 is a front view of another embodiment of the invention.

FIG. 9 is a rearward view of FIG. 8 illustrating a glass case where the flap is positioned over the glass member of the frames.

FIG. 10 is a view of the embodiment of FIGS. 8 and 9 showing the location of the flap prior to insertion into the eye case.

FIG. 11 is a sectional view taken along line 11—11 of FIG. 9.

FIG. 12 is a front view of another embodiment of the invention.

FIG. 13 is a rear view of the embodiment of FIG. 12 wherein the flap and the clasp are shown integral with one another.

FIG. 14 is another view of the embodiment of FIGS. 12 and 13 where a Velcro clasp is depicted integrally joined to the covering flap.

FIG. 15 is a sectional view taken along line 15—15 of FIG. 13.

FIG. 16 is a front view of another embodiment of the invention.

FIG. 17 is a rear view of the embodiment of FIG. 16 where the integrally formed strap of a glass case includes a strap that fastens to the front of the case.

FIG. 18 is another view of the eye case of FIGS. 16 and 17.

FIG. 19 is a sectional view taken along line 19—19 of FIG. 17

DESCRIPTION OF THE PREFERRED EMBODIMENT

Figure 4:
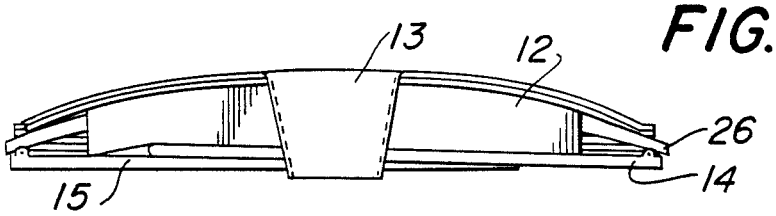
FIG. 4 is a plan view of FIGS. 1 and 2.

Referring to the Drawings and to FIG. 1 in particular, there is represented a front view of the invention, which basically illustrates an outer covering 18, a strap 13 and a flap 12 of the case 10. Eyeglasses are located within the case (not shown) and only temple pieces 14, 15 are partially illustrated.

FIG. 2 provides a rearward view of FIG. 1 where the frame 26 including the lenses are positioned inside a pocket **12*a* (See FIG. 3), whereas, the temple pieces 14, 15 are located outside of the pocket and are protected as well as secured by the flap 12 and strap 13. A hasp 16 is connected to the end of the strap 13 for firmly positioning the flap 12 against the temple pieces 14, 15** and to maintain the case as a compact unit when inside a purse or article of clothing.

The case 10 is shown in FIG. 3 in an open position without eyeglasses for obtaining a perspective view of some of its various components. The case 10 illustrates the pocket **12*a* for insertion of the portion of the frame 26 (See FIG. 2) containing the lenses including the slots 27, 28 where the temple pieces 14, 15 are brought outside. The front of the case 10 is slightly convex in shape since the frames are slightly bowed (See FIG. 4) when inserted into the pocket 12*a*. As a result of this convex configuration in the front of the case the back is formed in a slightly concave cross section. The flap 12, which is joined to the back portion of the front side of the case 10 is shown in an open position and may be closed upon the pocket 12***a* by bringing the cross member 20 on the hasp 16 (See FIG. 2) into engagement with a receptacle, such as receptacle 24, by an opening of the cover 21. The connection is completed by closing the cover 21 upon the cross member 20.

A sectional view of the eyeglass case 10 taken through FIG. 2 is shown in FIG. 5. The sectional view of the case 10 illustrates how it is provided with an outer skin 18 that may be made of a high quality hide, silk, synthetic material or metal. In the front area of the case 10 and in juxtaposition to the outer skin 18 is located a solid core 17 for the purpose of protecting the lenses and frame from possible damage by a high impact blow or similar destructive force. An inner lining 19 of felt or similar material is also furnished for placement against the core 17 to protect the contents of the case 10 against scratching and to provide a soft cushion as protection.

The flap 12 originates from the top and front of the case 10 where it is attached via the stitching 12*b*. As may be readily appreciated the flap 12 is brought over the top of the eye frames 26 located within the pocket 12*a* and the temple pieces 14, 15 positioned outside of the case. The sectional view also presents a view of the strap 13 and the hasp 16 where cross member 20, which is located through a loop at the end of the strap, is positioned in a middle receptacle 24 of the three receptacles provided. The cross member 20 (See FIGS. 2, 3) is positioned in the bottom portion of the hasp 16 by opening the cover 21 and rotating it in a clockwise direction through pivot pin 22. As understood, a person may select any one of the three receptacles in the bottom portion of hasp 16 depending upon the thickness of the temple pieces 14, 15 and the tightness desired for the strap 13 against these pieces.

A small triangular insert 23 is located within the pocket 12*a* between the inner lining 19 located in the front and rear sections of the case 10. The insert 23 is held in position by a rivet 9. The insert 23 is designed to fit within the nose opening provided in the frame 26; and, the top of the nose guard 26*a* is designated in cross section within the frames 26. The insert is designed to reduce movement of the frames 26 within the pocket 12*a*, therefore, protecting them from damage due to an excessive rattling motion.

Figure 6:
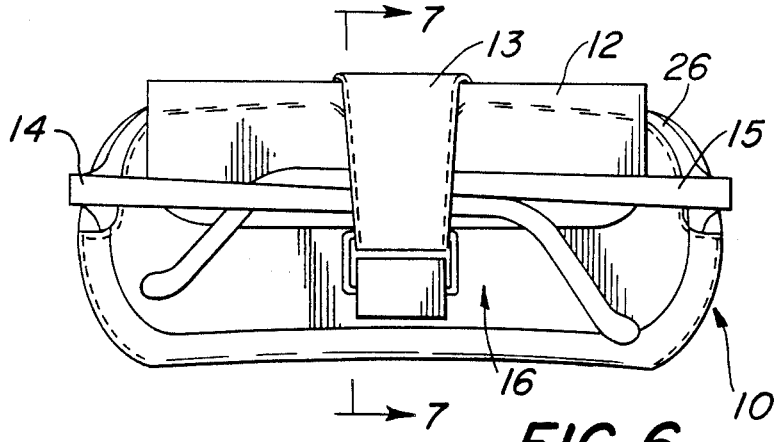
FIG. 6 is a rear view of another embodiment of the invention wherein the flap is positioned intermediate the temple pieces and the rear of the case.

FIG. 6 is another embodiment of the invention where the component parts of the eyeglass case 10 are the same as those described with respect to FIGS. 1–5 except that the flap 12 is located under rather than over the temple pieces 14, 15. In operation the strap 13 is brought over the temple pieces and secured by means of the hasp 16. The locating of the temple pieces 14, 15 between the flap 12 and strap 13 firmly positions the frames 26 within the pocket 12*a* (See FIG. 7) such that there is little or no movement. Accordingly, the embodiment of FIGS. 1–5 can be modified as in FIG. 6 without any diminution of protection to the eyeglass frames 26 or its temple pieces 14, 15.

Figure 7:
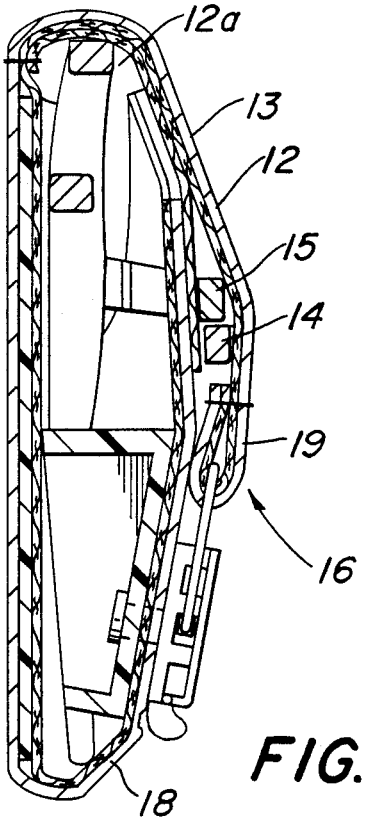
FIG. 7 is a cross-sectional view taken along line 7—7 of the embodiment of FIG. 6.

The sectional view of FIG. 7 which is taken through FIG. 6 is similar in scope and appearance to FIG. 5 except that the flap 12 is clearly illustrated as being oriented against the outer skin 18. Since the flap 12 is a relatively soft and pliant material it will protect the inside portion of the ear pieces 14, 15 as the strap 13 is secured to the case 10 by the action of the hasp 16. The outside portion of the temple pieces 14, 15 are protected by the inner felt lining 19 located on the inside of strap 13. In all other respects the eyeglass case 10 of FIGS. 6 and 7 is identical to that of FIGS. 1–5.

FIGS. 8–11 present another embodiment of an eyeglass case of this invention. The front of the case as represented in FIG. 8, which is slightly convex in shape, depicts a small portion of the strap 31 and flap 32 as well as the ends of the temple pieces 33, 34. A view of the concave rear of the case 30 is provided in FIG. 9 where the flap 32 which is attached to the rear portion is positioned over the lenses (not shown) and within the pocket; in addition, the frames 36 and temple pieces 33, 34 are maintained in position by the strap 31 and hasp 35. Slots 43, 44 are furnished to allow for free movement of the temple pieces outside of the case 30. The hasp 35 is a clasping member which has mating male and female components as will be discussed in greater detail hereinbelow.

An isometric drawing of the eyeglass case 30 is illustrated in FIG. 10 where the flap 32, which is joined to the outer skin 37 along the rear portion of the case, is adapted for insertion into the eyeglass receiving pocket. The female member 40 of the hasp is attached to the strap 31 for mating with the male member 45 after cover 41 is opened by rotating in a clockwise manner around pivot 42. The flap 32 is utilized for covering the frames 36 (See FIG. 9) and lenses (not shown) when eyeglasses are located within the case 30 as may be more fully appreciated by referring to the sectional view of FIG. 11.

The arrangement of case 30 with respect to the sectional view of FIG. 11 is structurally similar to the sectional view of FIG. 5. The outer skin 37, which is made of high quality hide, silk, synthetic or metal, surrounds the case 30 including the strap 31. The preformed solid core 39 is positioned along the front section of case 30 and a liner of felt 38 is located along the rear surface of the core 39 as well as the rear section of the case and the rear surface. The temple pieces 33, 34 are positioned intermediate the back surface of the case represented by the outer skin 37 and the inner felt liner attached to the strap 31.

The flap 32 attached to the outer skin 37 and felt lining 38 by means of the stitching 46 along the back surface of the case 30. The flap 32 is also furnished with a soft felt liner 38*a* such that when it is positioned over the frames 36 and lenses (not shown) they will not be damaged as by scratching.

The hasp 35 attached to the end of strap 31 provides the female receptacle 40 for receiving the male unit 45 which mate with one another to achieve a tight and secure clasping action. The portion of the hasp containing the male projection 45 may be attached to the outer skin 37 by an adhesive or other type substitute.

The triangular insert 8 is also provided in this embodiment for resting the nose piece thereon and for eliminating movement of the frames 26. The triangular insert 8 is maintained firmly in position within case 30 by the rivet 7.

Another embodiment of the invention is shown in FIGS. 12–15. In FIG. 12 the outerskin 58 along the front of the case together with temple pieces 14, 42 are presented. The back of the case 50 is illustrated in FIG. 13 together with the flap 55 and a portion 56 of a integrally formed Velcro connector. The flap 55 is placed over the temple pieces 52, 53 in this embodiment and secured to the outer skin by use of the Velcro strap component 56.

The various parts of the case 50 may be clearly seen by referring to the isometric drawing of FIG. 14. The integrally formed flap 55 together with male Velcro component 56 is utilized for mating with the female Velcro component 57. A pocket 62 and slot 61 for receiving eyeglasses is provided in the case 50. As understood, a similar slot (not shown) opposite slot 61 is furnished to allow facile entrance of the eyeglasses.

FIG. 15, which is a sectional view taken through FIG. 13, illustrates the arrangement of the various component parts and their relationship with respect to one another. The outer skin 58, made of similar materials to those described in the above discussed embodiments, is used to integrally form the exterior layer of the case 50 as well as the flap 55 and strap connector 56. The solid core 59 is located along the front position of case 50 and immediately behind the outer skin 58. The felt inner lining 60 is located on the interior side of the outer skin along the back of the case and on the interior side of the core 58 along the front of the case. The temple pieces 53, 54 are positioned for protection against the back of the case 50 and the flap 55. The flap 55 is maintained securely in position by way of the mating between the female Velcro component 57 and the male Velcro component 56. It is well understood in the art that male and female Velcro components may be interchanged without diminishing the characteristics of the connection.

A triangular piece 5 is utilized as in the previously described embodiments to fit within the nose opening of the frames 54 to prevent its movement and therefore to eliminate the possibility of damage.

Another embodiment of the invention is provided in FIGS. 16–19 where FIG. 16 provides a view of the convex front of the eyeglass case 70. The case 70 also provides a female button-type receptacle 77 located upon strap 74 for mating with a male receptacle (not shown). The receptacle 77 attached to the strap 74 originates in the rear of the case, and passes through the tunnel 75 for engagement with the male-female connector. The temple pieces 71, 72 are shown extending slightly out of the case 70.

The rear view of the case 70 of FIG. 17 indicates that the temple pieces 71, 72 are brought outside through slots 83, 84 and are protected by the flap 73 which is secured by means of the strap 74 and the male connector 77 as discussed immediately above. A perspective view of the case 70 is provided in FIG. 18 where the long strap 74 including the female fastener 77 is integrally formed with flap 73. The tunnel 75 is provided in the case 70 for routing the strap 74 to the front section for fastening with a male connector. It is therefore readily apparent that the strap 74 must be greater in length than the previously discussed embodiments since the connection occurs in the front of the eyeglass case 70.

The sectional view of FIG. 19 shows the internal structural arrangement of the case 30. The outer skin 80, which is similar to the previously described embodiments, is an unitary member which is utilized to form the front and rear section as well as the flap 73 and strap 74. The embodiment employs the solid core 81 in the front section of the case and is placed intermediate the soft felt inner liner 82, the flap 73 and the strap 74. The temple pieces 71, 72 of the frames 76 are located between the rear side of the case 70 and the flap 73. T he securing of the strap 74 to the front of the case is achieved through use of the female connector 77 which mates with the female connector 78. A backing plate 79 is provided for fixing and maintaining the male connector 78 in position upon the case 70.

The triangular piece 6 is provided as in the previous embodiments to fit into the nose opening in the frames 76 to provide support and to prevent possible movement that may damage the temple pieces 71, 72. The triangular support 6 is firmly held in position by the male portion 78 of the connector including a backing plate 79.

In summary, an eyeglass case has been described which is generally slim in appearance while nevertheless furnishing maximum optical protection and compact storage in minimal space such as in a female's evening purse or a male's pocket. The invention provides a pre-formed solid core to protect the lenses in the event of an accidental heavy thrust upon the front section of the case. A triangular insert of plastic or like material is also furnished in the eyeglass case of the invention to fit within the nose opening of the frames to prevent movement of the frames and to protect it from an excessive rattling motion. The case herein described also includes a plurality of different clasps and hasps that may be utilized to maintain the frames and temple pieces firmly in position.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A single fastener glass case comprising:

(a) a horizontally oriented contoured receptacle having a front and rear section and an outer skin and inner lining for receiving a pair of eye glasses within a frame including temple pieces;

(b) a firm protective member positioned in said front section intermediate said skin and lining for safeguarding the optical members of said glasses;

(c) a first clasp member attached to said receptacle;

(d) a rectangular back flap means extending from the vicinity of said upper front section of said receptacle;

(e) a strap means positioned in juxtaposition to said flap means;

(f) a second clasp member attached to the end of said strap means; and (g) said flap means of said single fastener case being foldable over said frames and temple pieces when said strap means is brought into position to allow mating of said first and second clasp members.

2. A glass case in accordance with claim 1 wherein said inner lining comprises a soft and pliable material.

3. A glass case in accordance with claim 2 wherein said soft and pliable material is felt.

4. A glass case in accordance with claim 1 wherein said outer skin may be a natural, or alternatively, a synthetic material.

5. A glass case in accordance with claim 1 wherein said outer skin is metallic.

6. A glass case in accordance with claim 1 wherein a triangular means is located between the front and rear section and intermediate the ends of said receptacle.

7. A glass case in accordance with claim 1 wherein said rear section is convex in shape.

8. A glass case in accordance with claim 1 wherein said first and second clasp members comprise a hasp.

9. A glass case in accordance with claim 1 wherein said first and second clasp members comprise a tooth-acting clasp.

10. A glass case in accordance with claim 1 wherein said first and second clasp members comprise male and female Velcro members, respectively.

11. A glass case in accordance with claim 1 wherein said first and second clasp members comprise female and male Velcro members, respectively.

12. A glass case in accordance with claim 1 wherein said strap means is integrally formed with said flap means, and said strap means extending from said flap means for wrapping around said case and said first clasp member mating with said second clasp member which is located in the front section of said case.

13. A single fastener glass case comprising:

(a) a horizontally oriented contoured receptacle having a front and rear section for receiving a pair of eye glasses within a frame including temple pieces;

(b) said receptacle having an inner and outer covering;

(c) protective means positioned intermediate said inner and outer covering along said front section of said case for safeguarding the optical members of said glasses;

(d) a first adjustable clasp member attached to said receptacle upon said outer covering and along said rear section;

(e) a rectangular flap means extending from the upper front and rear sections of said receptacle for affording protection to the top portion of said frame and temple pieces;

(f) a strap means positioned in juxtaposition to said flap means;

(g) slot means located on opposite ends of said receptacle for allowing said temple pieces to be oriented outside said case;

(h) a second adjustable clasp member attached to the end of said strap means; and (i) said flap means of said single fastener case being folded upon said glasses when said strap means is brought into position to allow adjustable mating of said first and second clasp members for maintaining said glasses and temple pieces securely within said receptacle and protecting same.

14. A single fastener glass case comprising:

(a) a horizontally oriented contoured receptacle having a front and rear section for receiving a pair of eye glasses within a frame including temple pieces;

(b) said receptacle having an inner and outer covering;

(c) protective means positioned intermediate said inner and outer covering along said front section of said case for safeguarding the optical members of said glasses;

(d) a first clasp member attached to said receptacle upon said outer covering and along said front section;

(e) a rectangular shaped back flap means extending from the upper front section of said horizontally oriented receptacle;

(f) a strap means integrally formed with said flap means;

(g) a tunnel means located along the bottom of said receptacle for routing said strap means;

(h) a second clasp member attached to the end of said strap means; and (i) said flap means being folded upon said glasses when said strap means is brought into position through said tunnel and around to the front of said case to allow mating of said first and second clasp members for maintaining said glasses securely within said receptacle.

15. A glass case in accordance with claim 1 wherein said strap means and flap means are independent of one another for allowing said flap means to be folded over or alternatively, under said temple pieces, where said strap means is positioned over said temple pieces in either alternative.

16. A glass case in accordance with claim 1 wherein said first and second clasp members are adjustable.

* * * * *